US005809800A

United States Patent [19]

Deal

[11] Patent Number: 5,809,800

[45] Date of Patent: Sep. 22, 1998

[54] REMOVABLE DEBRIS FILTER FOR AN AIR CONDITIONING CONDENSING UNIT

[76] Inventor: Patrick J. Deal, 2424 3rd Ave., Terre Haute, Ind. 47807

[21] Appl. No.: 708,849

[22] Filed: Sep. 9, 1996

Related U.S. Application Data

[60] Provisional application No. 60/003,928 Sep. 18, 1995.

[51] Int. Cl.[6] ..... F25B 39/04

[52] U.S. Cl. ..... 62/507; 62/259.1; 55/500

[58] Field of Search ..... 62/506, 507, 508, 62/177, 183, 186, 259.1; 55/500, 467, 285

[56] References Cited

U.S. PATENT DOCUMENTS

| | | | |
|---|---|---|---|
| 2,705,990 | 4/1955 | Miller | 150/52 |
| 2,812,900 | 11/1957 | Mattews | 230/275 |
| 3,907,531 | 9/1975 | Lee et al. | 55/500 |
| 4,261,418 | 4/1981 | Helt et al. | 165/134 |
| 4,340,115 | 7/1982 | Wright et al. | 165/122 |
| 4,475,585 | 10/1984 | Hoeffken | 165/134 |
| 4,815,530 | 3/1989 | Scott | 165/134 |
| 5,097,678 | 3/1992 | Aubuchon | 62/506 |
| 5,131,463 | 7/1992 | Zimmerli et al. | 165/119 |

*Primary Examiner*—John M. Sollecito
*Attorney, Agent, or Firm*—Woodard, Emhardt, Naughton, Moriarty & McNett

[57] ABSTRACT

A removable debris filter for an air conditioning condensing unit. The filter preferably comprises a quantity of fiberglass screen material having a drawstring seam attached onto opposite ends thereof. The screen material is wrapped around all four vertical sides of the air conditioning condensing unit and is held in place thereon by pulling each drawstring tight and tying a knot. The fineness of the screen mesh is adequate to prevent most airborne debris from entering the condensing unit, and the drawstrings allow the filter to be easily removed from the condensing unit for cleaning.

8 Claims, 4 Drawing Sheets

REMOVABLE DEBRIS FILTER FOR AN AIR CONDITIONING CONDENSING UNIT

This application claims priority under 35 U.S.C. §119 (e) to provisional application Ser. No. 60/003,928, filed Sep. 18, 1995.

TECHNICAL FIELD OF THE INVENTION

The present invention generally relates to filters and, more particularly, to a removable debris filter for an air conditioning condensing unit.

BACKGROUND OF THE INVENTION

In residential and commercial air conditioning systems, it is common to have a split system central air conditioning system in which the condensing unit is located outdoors. A typical condensing unit is illustrated in FIG. 1 and indicated generally at 10. The condensing unit 10 is operative to continuously draw ambient air across one or more condensing coils 12 (see FIG. 5) in which the system refrigerant circulates. In order to create this air movement, a blower motor is operated to spin a bladed fan (not shown), causing a flow of air out of the fan outlet 14 located on top of the condensing unit 10. This outflow of air creates a negative pressure within the condensing unit 10.

The sides of the condensing unit 10 are generally open to the surrounding atmosphere, having only a widely spaced metal grid 16 thereon. The metal grid 16 is effective in keeping large objects (such as animals) out of the condensing unit, but does not impede the flow of air. Consequently, the negative pressure within the condensing unit 10 causes large quantities of air to be sucked in through the metal grid 16.

Because of the wide spacing of the metal grid 16, any small airborne objects in the immediate vicinity of the condensing unit 10, such as insects, grass clippings, dirt, cottonwood seeds, dryer lint and other debris will be drawn into the coils 12 of the condensing unit 10, thereby clogging the coils 12.

Operating the condensing unit 10 with clogged coils 12 lowers the efficiency and decreases the life expectancy of the air conditioning system. This results in higher electrical costs and the need to replace the system sooner. The coils 12 may be cleaned, however conventional methods of cleaning the coils 12 are difficult, environmentally unfriendly, and dangerous for a homeowner to perform. These conventional methods require disassembly of the outer shell of the condensing unit 10, application of a commercial cleaning solvent to the clogged coils 12, and rinsing the solvent off of the coils 12 with a garden hose. Not only does this result in the run-off of the solvent into the surrounding earth (an environmental hazard), but there is also a risk of electrocution if the electrical supply (220 VAC) to the condensing unit 10 is not disconnected.

There is therefore a need for a means for preventing an air conditioning condenser unit 10 from becoming clogged with airborne debris, thereby obviating the need to clean the coils 12 of the condensing unit 10. The present invention is directed toward meeting this need.

SUMMARY OF THE INVENTION

The present invention relates to a removable debris filter for an air conditioning condensing unit. The filter preferably comprises a quantity of fiberglass screen material having a drawstring seam attached onto opposite ends thereof. The screen material is wrapped around all four vertical sides of the air conditioning condensing unit and is held in place thereon by pulling each drawstring tight and tying a knot. The fineness of the screen mesh is adequate to prevent most airborne debris from entering the condensing unit, and the drawstrings allow the filter to be easily removed from the condensing unit for cleaning.

In one form of the invention a removable debris filter for an air conditioning condensing unit is disclosed, comprising a piece of mesh material having first, second, third and fourth edges; a first channel formed along the first edge; a first drawstring disposed within the first channel; a second channel formed along the second edge; a second drawstring disposed within the second channel; wherein the filter may be mounted to the condensing unit by wrapping the mesh material around the condensing unit, bringing the third and fourth sides together, pulling the first and second drawstrings tight, tying ends of the first drawstring together and tying ends of the second drawstring together.

In another form of the invention a removable debris filter for an air conditioning condensing unit is disclosed, comprising a piece of mesh material having first, second, third and fourth corners; and first, second, third and fourth attachment means coupled to the mesh material near the first, second, third and fourth corners, respectively; wherein the filter may be mounted to the condensing unit by wrapping the mesh material around the condensing unit, joining the first and second attachment means, and joining the third and fourth attachment means.

DETAILED DESCRIPTION OF THE PREFERRED EMBODIMENT

Figure 1:
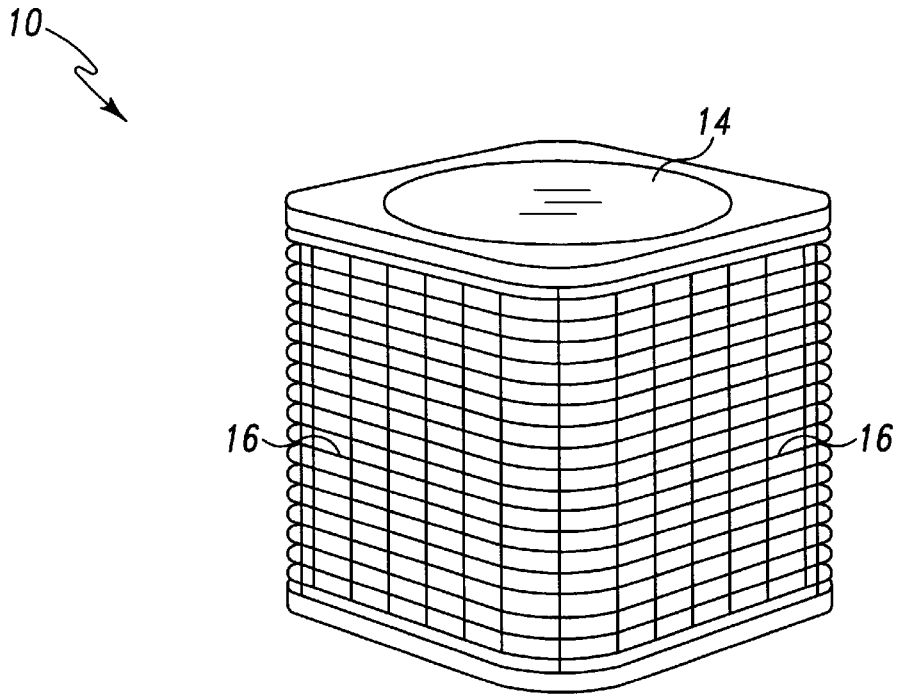
Fig. 1 (PRIOR ART)
FIG. 1 is a perspective view of a prior art air conditioning condensing unit.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
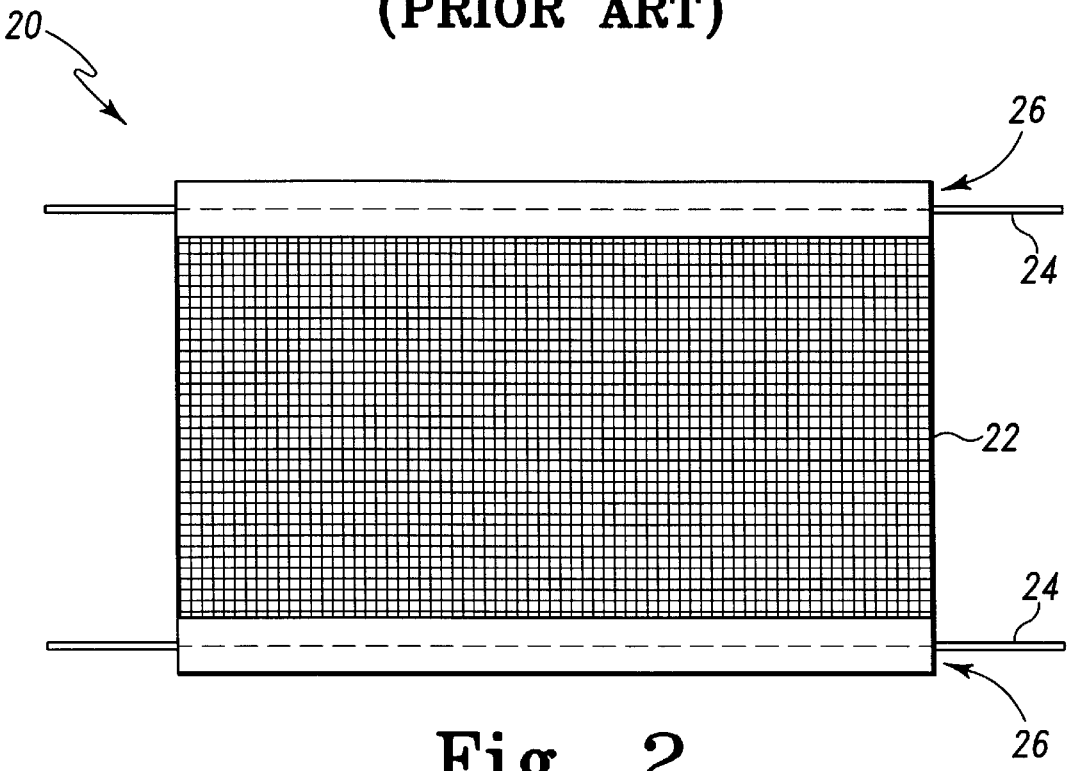
FIG. 2 is a plan view of a preferred embodiment of the present invention.

A preferred embodiment of the removable debris filter of the present invention is illustrated in FIG. 2 and indicated generally at 20. The filter 20 is constructed from a quantity of screen mesh 22, preferably fiberglass screen such as is commonly used on storm doors and windows. The fiberglass screen material is preferred due to its ability to withstand adverse weather conditions and due to the fineness of its mesh weave which is generally adequate to prevent insects, grass clippings, dirt, cottonwood seeds, dryer lint and other debris from passing through the screen 22. The height of the screen 22 should be selected to approximately equal the height of the condensing unit 10, while the length of the screen 22 should be sufficient to allow the screen 22 to wrap around all four sides of the condensing unit 10 (or completely around the circumference of a cylindrical condensing unit). A drawstring 24 is provided on each of two opposite sides of the filter 20 in order to provide a convenient means for securing the filter 20 to the condensing unit 10. The drawstrings 24 are preferably made from cord material which can withstand adverse weather conditions, such as the cord commonly used for outdoor clotheslines. The drawstrings 24 are each loosely retained within a hollow channel 26. The channel 26 may be conveniently formed by folding over the edge of the screen 22 and tacking down the free end. Alternatively, the channel 26 may be formed by folding a separate piece of material, such as vinyl, over the edge of the screen 22 and sewing both ends of this material to the screen 22. In either situation, it is preferred that the channel 26 be large enough to allow free movement of the drawstring 24 within the channel 26. The seams which create the channel 26 are preferably sewn with weather resistant thread, such as that used in the manufacture of canvas awnings, tents, etc. As an alternative to the drawstrings 24, four pieces of cord may be substituted therefore, with one end of each piece of cord being sewn to a respective corner of the screen material 22. Other alternative attachment means will be apparent to those skilled in the art, such as hook and loop tape, buckles, etc.

Figure 3A:
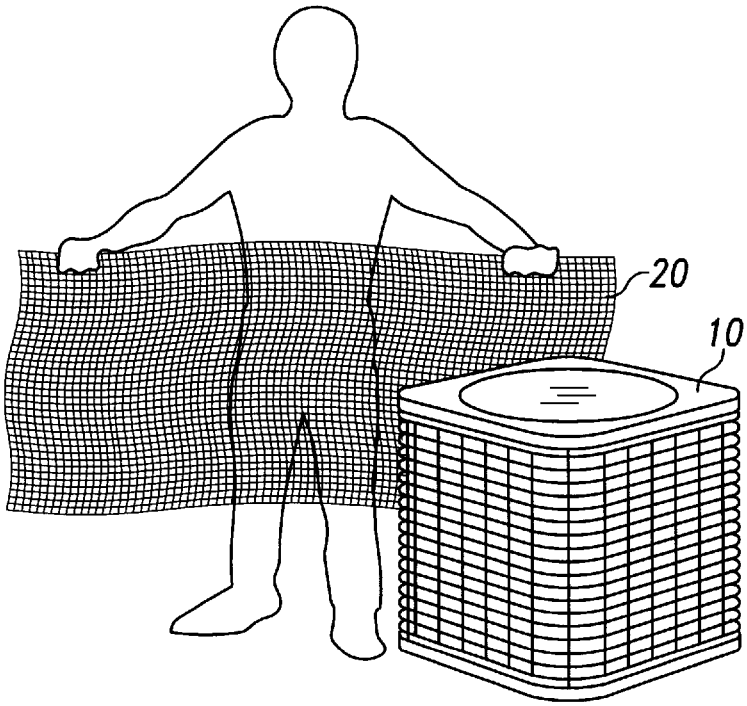
FIGS. 3A–D illustrate a preferred method of applying the present invention to an air conditioning condensing unit.
Figure 3B:
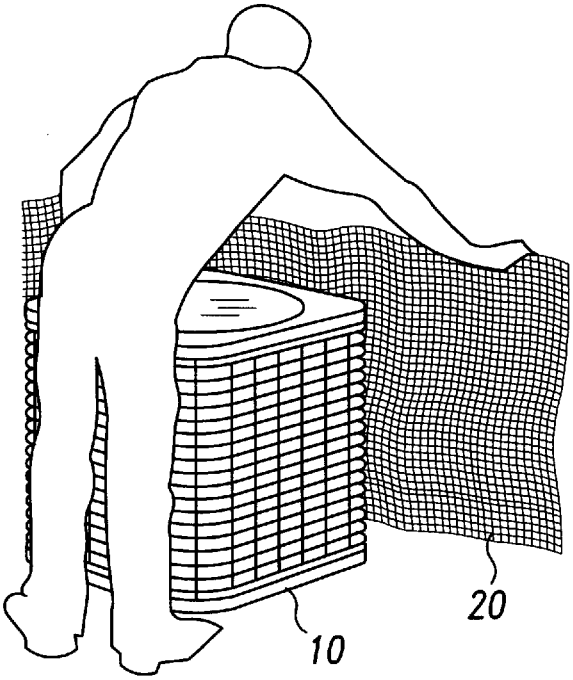
Figure 3C:
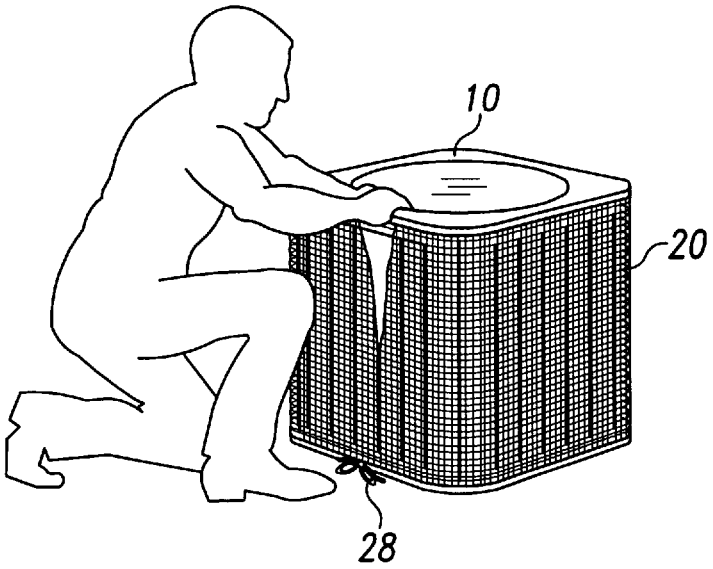
Figure 3D:
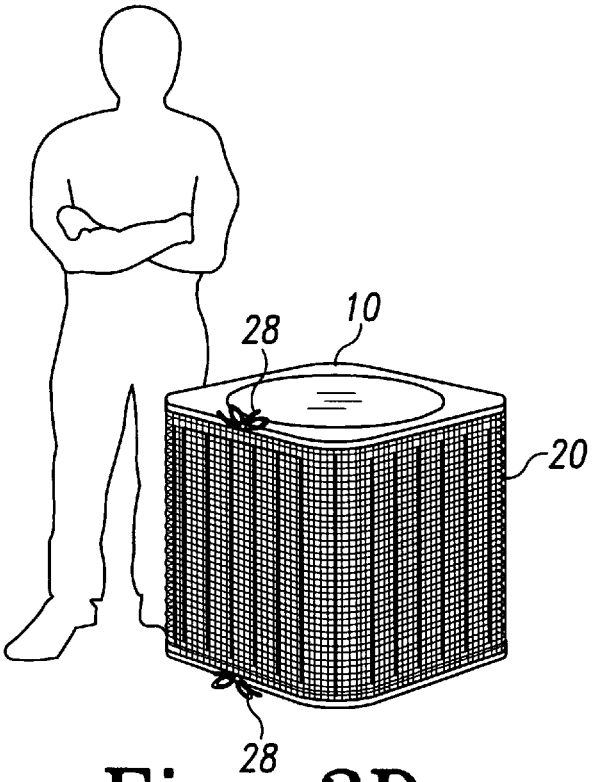
Figure 4:
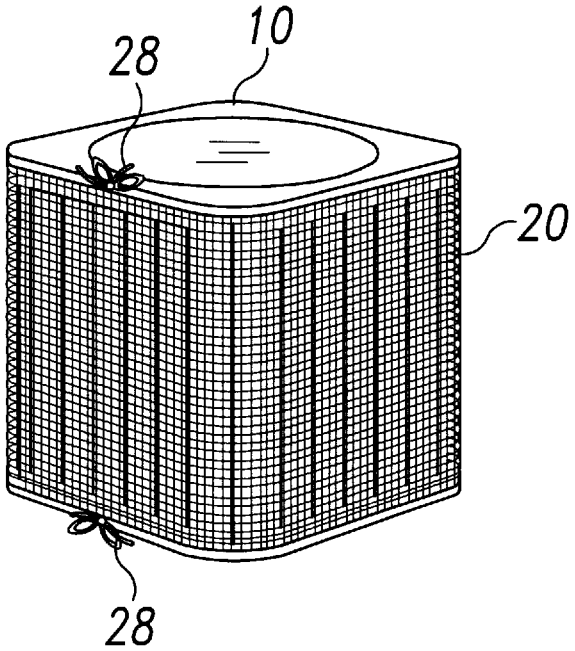
FIG. 4 is a perspective view of a prior art air conditioning condensing unit wrapped in a preferred embodiment of the present invention.
Figure 5:
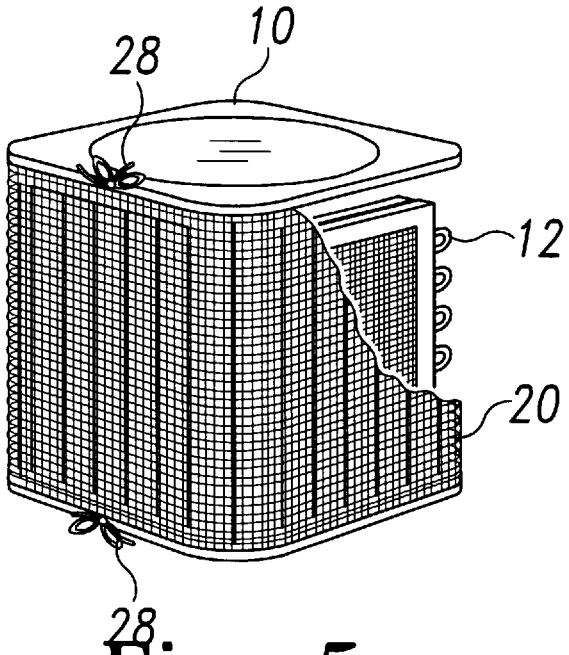
FIG. 5 is a cut-away perspective view of a prior art air conditioning condensing unit wrapped in a preferred embodiment of the present invention, showing the condenser coils within the condensing unit.

As illustrated in FIGS. 3A–D, the removable debris filter 20 is easily installed upon a condensing unit 10. In FIG. 3A, the filter 20 is grasped by its top edge and is then wrapped around the vertical sides of the condensing unit 10 (see FIG. 3B). As shown in FIG. 3C, once the filter 20 has been wrapped around the condensing unit 10, the drawstrings 24 at the top and the bottom of the filter 20 are pulled tight and tied into a knot 28. The entire procedure is quick and simple, and the filter 20 may be removed from the condensing unit 10 by simply reversing the steps. The installed removable debris filer 20 is shown in FIG. 4, while FIG. 5 illustrates a cut-away view showing the relationship between the condenser coils 12 and the removable debris filter 20.

The filter 20 of the present invention has several advantages over a more permanent filter that could be designed into the condensing unit 10. For example, the filter 20 is relatively inexpensive and may be easily constructed from commonly available materials. Also, because the filter 20 is secured to the exterior of the condensing unit 10 by simple knots, it is easily removed for periodic cleaning. For example, the filter 20 may be removed from the condensing unit and then cleaned with an ordinary garden hose. After the filter 20 has been cleaned, it may be easily resecured to the condensing unit 10. Furthermore, because the filter 20 is installed on the outside surface of the condensing unit 10, it will be apparent after a quick visual inspection of the filter 20 whether it is sufficiently clogged with debris in order to warrant removal and cleaning. Finally, no commercial solvents are required to clean the filter 20, thereby making it environmentally safe.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A removable debris filter and an air conditioning condensing unit in combination, comprising:

an air conditioning condensing unit having an exterior surface;

a piece of mesh material having first, second, third and fourth edges and first, second, third and fourth corners; and first, second, third and fourth attachment means positioned near the first, second, third and fourth corners, respectively;

wherein the filter is mounted to the condensing unit by wrapping the mesh material around the exterior surface of the condensing unit, joining the first and second attachment means, and joining the third and fourth attachment means.

2. The combination of claim 1, wherein the first, second, third and fourth attachment means comprise cords attached at one end thereof to the mesh material.

3. The combination of claim 1, wherein the mesh material is a fiberglass screen.

4. The combination of claim 1, further comprising a first channel formed along the first edge;

a first drawstring disposed within the first channel, wherein the first and second attachment means comprise respective first and second ends of the first drawstring;

a second channel formed along the second edge; and a second drawstring disposed within the second channel, wherein the third and fourth attachment means comprise respective third and fourth ends of the second drawstring;

wherein the filter is mounted to the condensing unit by wrapping the mesh material around the condensing unit, bringing the third and fourth sides together, pulling the first and second drawstrings tight, tying ends of the first drawstring together and tying ends of the second drawstring together.

5. The removable debris filter of claim 4, wherein the mesh material is a fiberglass screen.

6. The removable debris filter of claim 4, wherein:

the first channel is formed by folding over the first edge and attaching the first edge to the mesh material; and the second channel is formed by folding over the second edge and attaching the second edge to the mesh material.

7. The removable debris filter of claim 4, wherein:

the first channel is formed by folding a first piece of channel material over the first edge and attaching the first piece to the mesh material; and the second channel is formed by folding a second piece of channel material over the second edge and attaching the second piece to the mesh material.

8. The removable debris filter of claim 7, wherein the first and second pieces of channel material are vinyl.

* * * * *

UNITED STATES PATENT AND TRADEMARK OFFICE
CERTIFICATE OF CORRECTION

PATENT NO : 5,809,800

DATED : September 22, 1998

INVENTOR(S) : Patrick J. Deal

It is certified that error appears in the above-identified patent and that said Letters Patent are hereby corrected as shown below:

In column 4, line 62, please add --9. The combination of claim 1, wherein the first, second, third and fourth attachment means comprise hook and loop tape.--

Signed and Sealed this

Fourteenth Day of December, 1999

*Attest:*

Q. TODD DICKINSON

*Attesting Officer*

*Acting Commissioner of Patents and Trademarks*